United States Patent [19]

Field et al.

[11] Patent Number: 4,586,477

[45] Date of Patent: May 6, 1986

[54] FUEL RAIL ASSEMBLY

[75] Inventors: Martin J. Field, Churchville; Donald A. Rosin, Rochester, both of N.Y.

[73] Assignee: General Motors Corporation, Detroit, Mich.

[21] Appl. No.: 740,416

[22] Filed: Jun. 3, 1985

[51] Int. Cl.[4] ..... F02M 55/00

[52] U.S. Cl. ..... 123/468

[58] Field of Search ..... 123/468, 469, 470, 456; 138/37, 112

[56] References Cited

U.S. PATENT DOCUMENTS

| | | | |
|---|---|---|---|
| 4,485,790 | 12/1984 | Nishimura et al. | 123/468 |
| 4,510,909 | 4/1985 | Elphick et al. | 123/470 |
| 4,519,368 | 5/1985 | Hudson, Jr. | 123/470 |
| 4,539,961 | 9/1985 | Atkins et al. | 123/468 |

FOREIGN PATENT DOCUMENTS

| | | | |
|---|---|---|---|
| 2125893 | 3/1984 | United Kingdom | 123/468 |

*Primary Examiner*—Magdalen Y. C. Moy

*Attorney, Agent, or Firm*—C. K. Veenstra

[57] ABSTRACT

A fuel rail assembly has a pair of fuel rail bodies each of which has a bore extending parallel to the fuel supply passage. Each bore has a plug dividing the bore into inlet and discharge regions. The inlet regions are interconnected by an inlet crossover tube, and each inlet region opens to its associated supply passage through a window and a restriction at one end of the associated fuel rail body to balance fuel flow to the supply passages. At the other end of each fuel rail body, a cross bore extends through the discharge region to the supply passage, and discharge tubes received in the cross bores discharge fuel from the supply passages to a pressure regulator.

1 Claim, 8 Drawing Figures

FUEL RAIL ASSEMBLY

TECHNICAL FIELD

This invention relates to an improved fuel rail assembly for supplying fuel to a V-engine.

BACKGROUND

In a fuel rail assembly for a V-engine, a pair of fuel rail bodies are often employed to support and supply fuel to a plurality of fuel injectors, each of which delivers fuel to the inlet port of an associated engine combustion chamber. Each fuel rail body has sockets for the injectors which are intersected by a supply passage extending from an inlet region to a discharge region. The inlet regions of the fuel rail bodies are interconnected by a crossover tube to receive fuel from a common source, and the discharge regions of the fuel rail bodies are connected by crossover and/or adapter tubes to a common pressure regulator.

SUMMARY OF THE INVENTION

This invention provides an improved fuel rail assembly suitable for supplying fuel to an automotive V-engine.

In a preferred embodiment of a fuel rail assembly provided by this invention, each of the fuel rail bodies has a bore which parallels and is connected at each end to the supply passage and is divided by a plug to form the inlet and discharge regions. By employing a separate bore for the inlet and discharge regions, the tube connections may be placed close together to efficiently employ the space available for the fuel rail assembly.

The details as well as other features and advantages of a preferred embodiment of this invention are set forth in the remainder of the specification and are shown in the accompanying drawings.

THE PREFERRED EMBODIMENT

Figure 1:
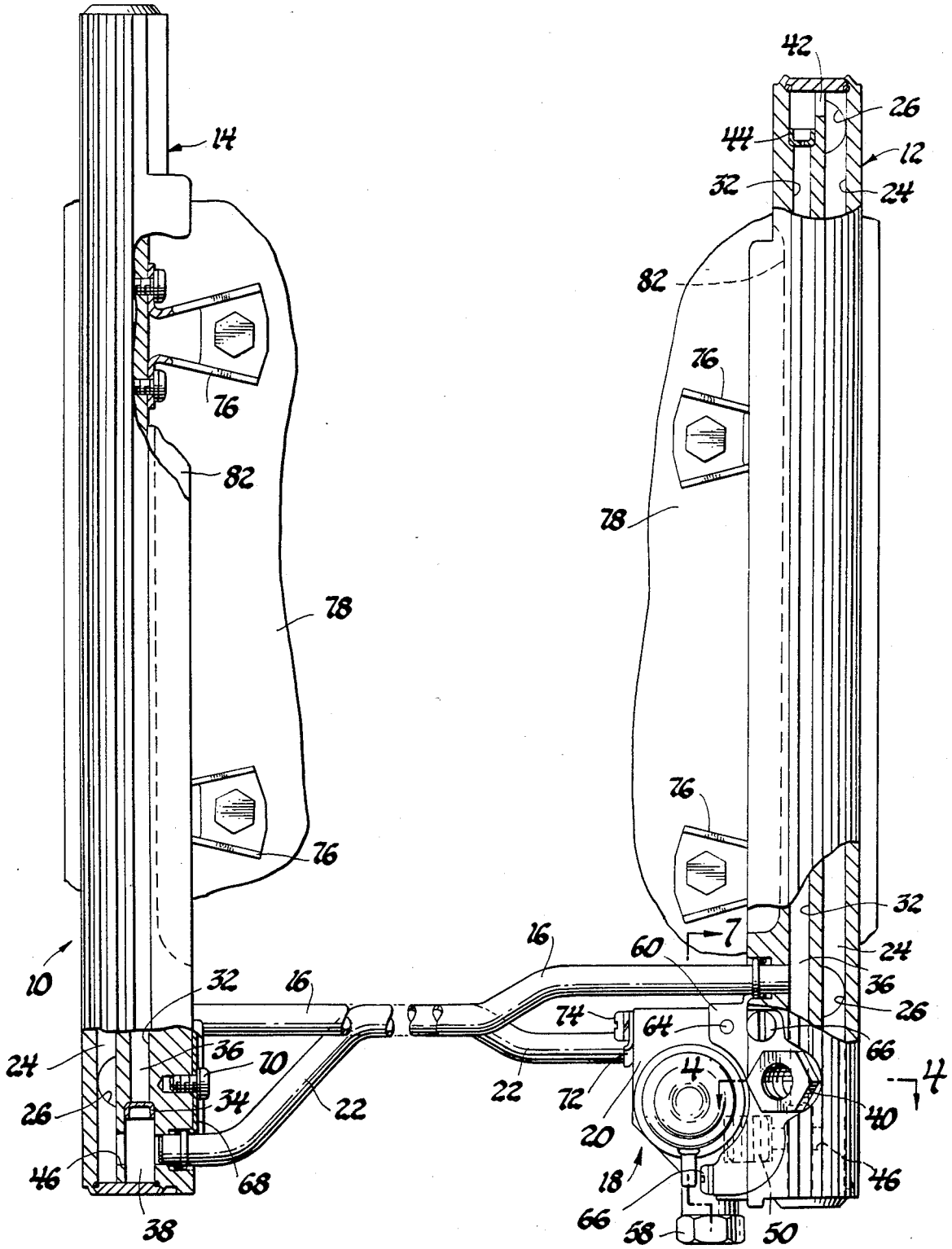
FIG. 1 is a plan view of a preferred embodiment of a fuel rail assembly employing this invention, with parts broken away to illustrate the connections between the supply passage and the inlet and discharge regions.
Figure 2:
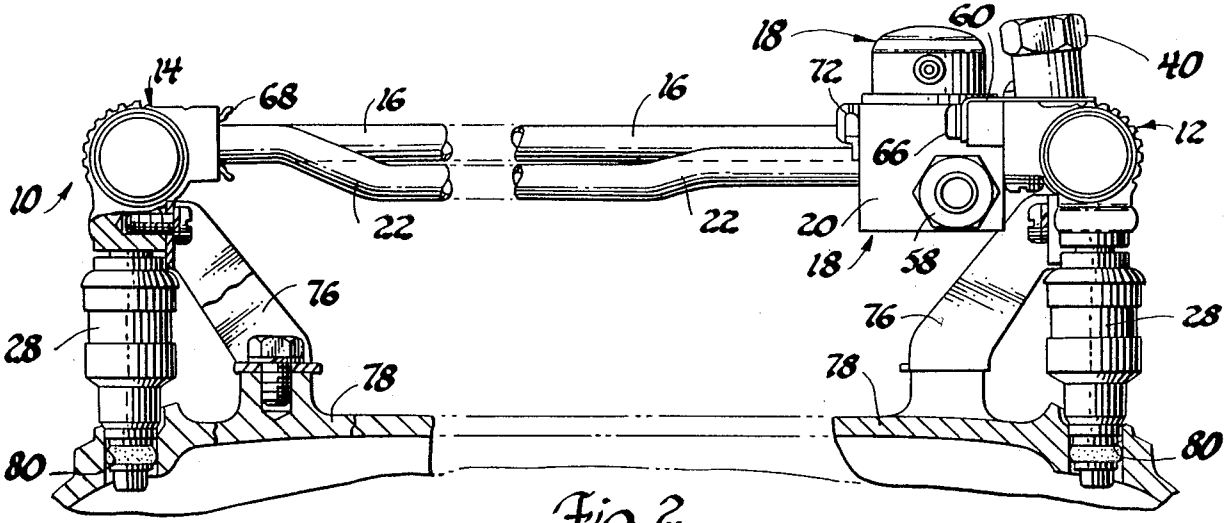
FIG. 2 is a rear view of the FIG. 1 assembly, illustrating its connection to the engine manifold.
Figure 3:
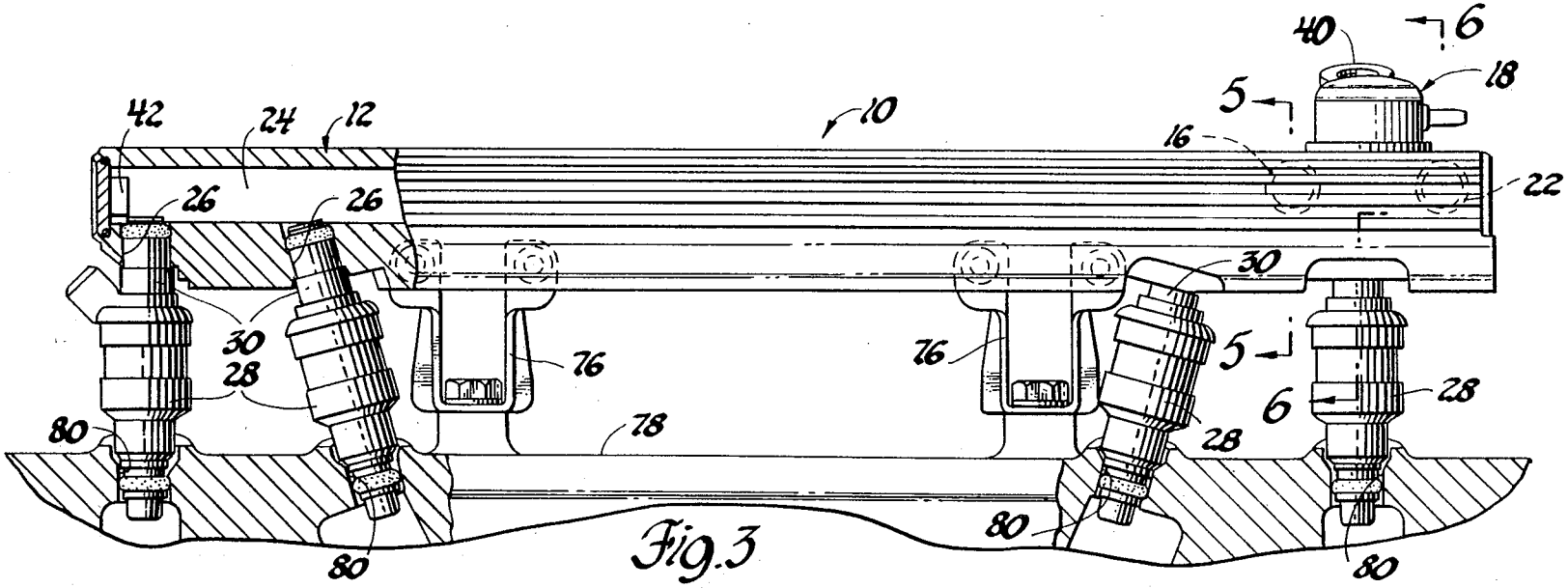
FIG. 3 is a left side view of the FIG. 1 assembly, with parts broken away to illustrate the intersection of the supply passage and the injector sockets.
Figure 4:
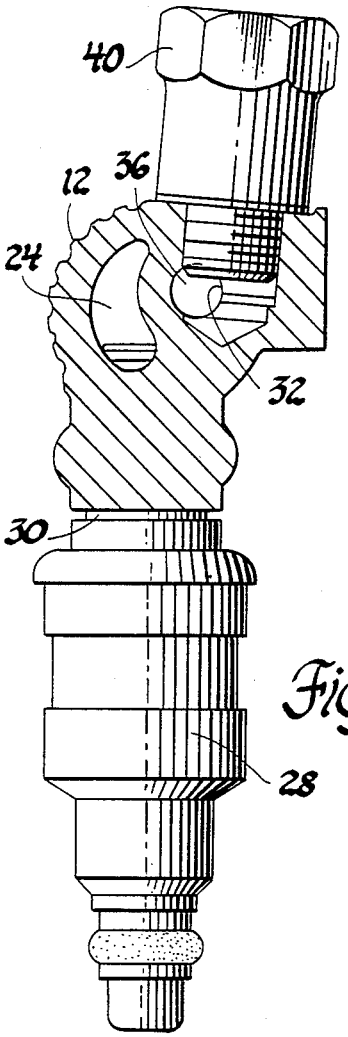
FIG. 4 is an enlarged sectional view taken along line 4—4 of FIG. 1, showing a fitting for supplying fuel to the inlet region of the righthand fuel rail body.
Figure 5:
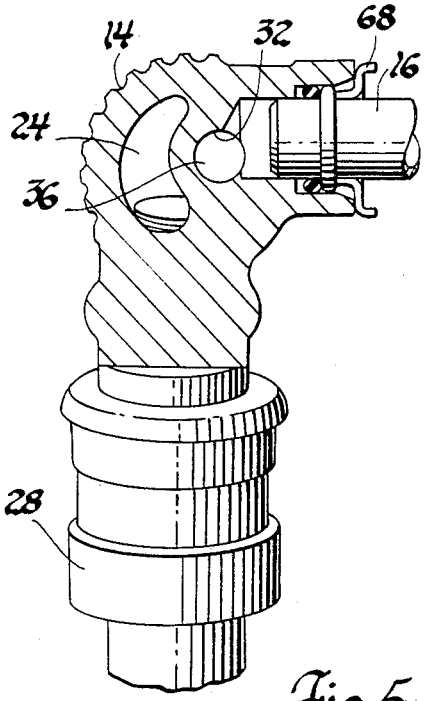
FIG. 5 is an enlarged sectional view taken along line 5—5 of FIG. 3, showing the crossover tube interconnecting the inlet regions of the fuel rail bodies.
Figure 7:
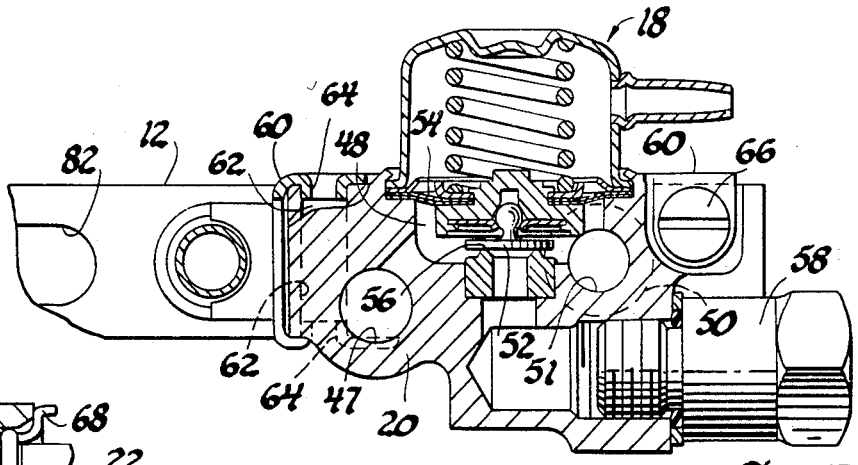
FIG. 7 is an enlarged sectional view taken along line 7—7 of FIG. 1, showing the construction of the pressure regulator.
Figure 6:
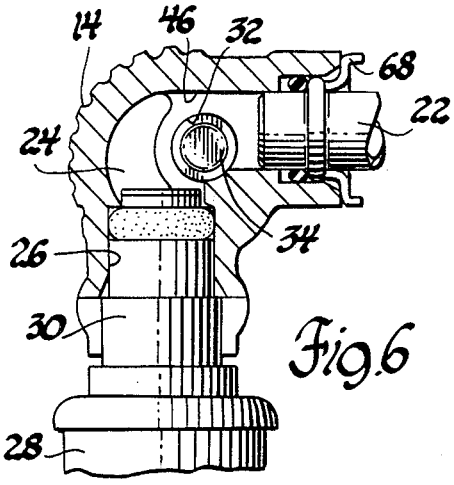
FIG. 6 is an enlarged sectional view taken along line 6—6 of FIG. 3, showing the crossover tube connecting the discharge region of the lefthand fuel rail body to the pressure regulator.
Figure 8:
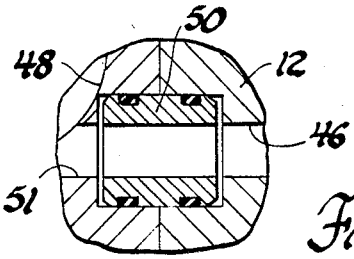
FIG. 8 is an enlarged fragmentary view of a portion of FIG. 1, showing the adapter tube connecting the discharge region of the righthand fuel rail body to the pressure regulator.

Referring to the drawings, a fuel rail assembly 10 includes righthand and lefthand fuel rail bodies 12 and 14 interconnected by an inlet crossover tube 16 and also includes a pressure regulator 18 having a base 20 connected to the lefthand fuel rail body 14 by a discharge crossover tube 22.

Each fuel rail body 12 and 14 has a supply passage 24 intersecting four injector sockets 26. Each injector socket 26 receives an injector 28 which is retained by a clip 30.

Each fuel rail body also has a bore 32 parallel to supply passage 24. Each bore 32 is divided by a cup plug 34 to form an inlet region 36 forward of plug 34 and a discharge region 38 rearward of plug 34. A fuel inlet fitting 40 provides fuel to the inlet region 36 of righthand fuel rail body 12, and inlet crossover tube 16 interconnects the inlet regions 36 to provide fuel to the inlet region 36 of lefthand fuel rail body 14.

At the forward end of each fuel rail body 12 and 14, the inlet region 36 formed by each bore 32 is connected to supply passage 24 through a machined window 42, and a cup restrictor 44 limits fuel flow from each inlet region 36 to its associated supply passage 24 to thereby balance fuel flow through the lefthand and righthand fuel rail bodies 12 and 14.

At the rearward end of each fuel rail body 12 and 14, a cross bore 46 extends through bore 32 to connect supply passage 24 with discharge region 38. Discharge crossover tube 22 is received in the cross bore 46 of lefthand fuel rail body 14 to connect the associated discharge region 38 to a bore 47 formed in pressure regulator base 20. Bore 47 is connected to a pressure regulator chamber 48. A discharge adapter tube 50 is received in the cross bore 46 of the righthand fuel rail body 12 to connect the associated discharge region 38 to a bore 51 formed in pressure regulator base 20 which also leads to chamber 48.

It will be appreciated, therefore, that fuel flows from inlet fitting 40 to the inlet region of righthand fuel rail body 12, and from there through inlet crossover tube 16 to the inlet region 36 of lefthand fuel rail body 14. From inlet regions 36, fuel flows through restrictors 44 and windows 42 to supply passages 24. Injectors 28 deliver fuel from supply passages 24, and the excess fuel flows through cross bores 46 to discharge regions 38 and then through discharge tubes 22 and 50 and bores 47 and 51 to pressure regulator chamber 48.

Pressure regulator 18 includes a valve 52 positioned by a diaphragm 54 to control fuel flow from chamber 48 past a valve seat 56 to a discharge fuel fitting 58. Valve 52 is positioned to maintain a desired pressure in chamber 48 and thus in discharge regions 38 and supply passages 24.

Pressure regulator 18 is mounted to righthand fuel rail body 12 by a bracket 60. Bracket 60 wraps over both the top and the bottom of pressure regulator base 20 and is staked into openings 62 in base 20 as shown at 64 for permanent retention by base 20. Screws 66 secure bracket 60 to fuel rail body 12 and further secure bracket 60 to pressure regulator base 20.

Crossover pipes 16 and 22 are secured to lefthand fuel rail body 14 by a retainer 68 and a screw 70, and discharge crossover pipe 22 is secured to pressure regulator base 20 by a retainer 72 and a screw 74. Inlet crossover pipe 16 is shown here as secured to righthand fuel rail body 12 by bracket 60, but it will be appreciated that inlet crossover pipe 16 could be secured to right-hand fuel rail body 12 by a separate retainer and screw.

Brackets 76 secure fuel rail assembly 10 to the engine manifold 78. The tips of injectors 28 are received in openings 80 in manifold 78 to allow injectors 28 to deliver fuel for mixture with the air flowing to the engine combustion chambers.

A groove 82 formed along the inside of each fuel rail body 12 and 14 allows the wiring for injectors 28 to be nestled into and retained by fuel rail bodies 12 and 14.

It should be appreciated that fuel rail assembly 10 includes features claimed in copending applications Ser. No. 410611 filed Aug. 23, 1982 in the name of L. H. Weinand, Ser. No. 410612 filed Aug. 23, 1982 in the names of T. J. Atkins, M. J. Field and D. J. Lamirande, Ser. No. 410641 filed Aug. 23, 1982 in the names of T. J. Atkins, M. J. Field and D. J. Lamirande, Ser. No. 597080 filed Apr. 5, 1984 in the names of T. G. Elphick, E. S. Eshleman and M. J. Field, Ser. No. 622952 filed June 21, 1984 in the names of T. J. Atkins, M. J. Field and A. J. Makusij, and Ser. No. 622954 filed June 21, 1984 in the name of M. J. Field. Reference should be made to the disclosures of those applications for additional details of fuel rail assembly 10.

The embodiments of the invention in which an exclusive property or privilege is claimed are defined as follows:

1. A fuel rail assembly comprising a pair of fuel rail bodies each having a fuel supply passage and a bore substantially parallel to said passage, each of said bores having a plug dividing the bore into an inlet region and a discharge region, one of said fuel rail bodies having an inlet fuel fitting for providing fuel to the associated inlet region, an inlet crossover tube for fuel flow from the inlet region of said one fuel rail body to the inlet region of the other fuel rail body, each of said fuel rail bodies having a window for fuel flow from the associated inlet region to one end of the associated supply passage and including a restriction for balancing the fuel flow through said inlet regions to said supply passages, each of said fuel rail bodies further having a connection for fuel flow from the other end of the associated supply passage to the associated discharge region and wherein at least one of said connections is formed by a cross bore extending through the associated discharge region to the other end of the associated supply passage, and a discharge tube received in said cross bore for discharging fuel from said discharge region, whereby said inlet crossover tube and said discharge tube are disposed closely adjacent one another to minimize the space required for the fuel rail assembly.

* * * * *